US010376056B2

(12) United States Patent
Schneider

(10) Patent No.: US 10,376,056 B2
(45) Date of Patent: Aug. 13, 2019

(54) DEVICE FOR MOUNTING A REAR WALL ON A MOVABLE FURNITURE COMPONENT

(71) Applicant: Grass GmbH, Hoechst (AT)

(72) Inventor: Klaus Schneider, Hoechst (AT)

(73) Assignee: Grass GmbH, Hoechst (AT)

( * ) Notice: Subject to any disclaimer, the term of this patent is extended or adjusted under 35 U.S.C. 154(b) by 0 days.

(21) Appl. No.: 15/493,487

(22) Filed: Apr. 21, 2017

(65) Prior Publication Data

US 2017/0303686 A1 Oct. 26, 2017

(30) Foreign Application Priority Data

Apr. 25, 2016 (DE) ..... 20 2016 102 168 U

(51) Int. Cl.
*A47B 88/90* (2017.01)
*A47B 88/95* (2017.01)

(52) U.S. Cl.
CPC ..... *A47B 88/941* (2017.01); *A47B 88/90* (2017.01); *A47B 88/95* (2017.01); *A47B 2088/902* (2017.01)

(58) Field of Classification Search
CPC ..... A47B 88/941; A47B 88/90; A47B 88/95; A47B 88/00; A47B 2088/902
USPC ..... 312/348.1, 348.2
See application file for complete search history.

(56) References Cited

U.S. PATENT DOCUMENTS 4,042,288 A * 8/1977 Litchfield ..... A47B 88/941 160/381
4,099,815 A * 7/1978 Cox ..... F16B 12/40 312/348.2
4,303,289 A * 12/1981 Hardy ..... F16B 12/50 312/140
4,815,796 A 3/1989 Röck et al.
5,181,772 A * 1/1993 Albiez ..... A47B 88/941 312/348.2
5,348,386 A * 9/1994 Grass ..... A47B 88/9412 312/348.2
5,743,608 A * 4/1998 Johannes ..... A47B 88/941 312/330.1
6,443,545 B1 * 9/2002 Woerner ..... A47B 88/9418 312/263

(Continued)

FOREIGN PATENT DOCUMENTS

DE 88 00 506 U1 3/1988
DE 20 2009 004 982 U1 12/2010

(Continued)

OTHER PUBLICATIONS

Extended European Search Report (Application No. 17164070.9) dated Sep. 21, 2017.

(Continued)

*Primary Examiner* — James O Hansen
(74) *Attorney, Agent, or Firm* — Burr & Brown, PLLC

(57) ABSTRACT

A device for mounting a rear wall on a movable furniture component of a piece of furniture, in particular on a drawer, with the movable furniture component including a rear wall and a drawer sidewall unit. The device is characterized in that the device is for arrangement between a rear wall holder extending on the drawer sidewall unit in a plane of the rear wall and the rear wall, and the device has an engagement mechanism for engagement in the rear wall holder.

15 Claims, 4 Drawing Sheets

(56) References Cited

U.S. PATENT DOCUMENTS

| | | | | |
|---|---|---|---|---|
| 7,857,404 | B2 * | 12/2010 | Lam | F16B 12/46<br>312/263 |
| 2012/0133259 | A1 | 5/2012 | Babucke-Runte et al. | |
| 2013/0257251 | A1 | 10/2013 | Gasser | |

FOREIGN PATENT DOCUMENTS

| | | | |
|---|---|---|---|
| EP | 012030 | * | 6/1980 |
| FR | 2 603 672 | A1 | 3/1988 |
| GB | 1 522 598 | A | 8/1978 |
| GB | 2 101 879 | A | 1/1983 |
| WO | 2010/036215 | A2 | 4/2010 |
| WO | 2012/068604 | A1 | 5/2012 |

OTHER PUBLICATIONS

German Search Report (Application No. 20 2016 102 168.5) dated Jan. 23, 2017.

* cited by examiner

DEVICE FOR MOUNTING A REAR WALL ON A MOVABLE FURNITURE COMPONENT

This application claims the benefit under 35 USC § 119(a)-(d) of German Application No. 20 2016 102 168.5 filed Apr. 25, 2016, the entirety of which is incorporated herein by reference.

FIELD OF THE INVENTION

The present invention relates to a device for mounting a rear wall on a movable furniture component of a piece of furniture, in particular, on a drawer, and a movable furniture component or a piece of furniture having a suchlike device.

BACKGROUND OF THE INVENTION

Self-assembly drawer kits for mounting the rear wall of a drawer on a drawer of a piece of furniture are previously disclosed.

Self-assembly drawer kits are previously disclosed, for example, in which a metallic drawer sidewall unit and the rear wall of the drawer are connected together without tools. The rear wall of the drawer is provided for this purpose with hooks, which are capable of being inserted into slots the drawer sidewall unit. The rear wall of the drawer further possesses positioning pins, which, in the assembled state, project into corresponding openings in the drawer sidewall unit, so that vertical displacement of the rear wall of the drawer relative to the sidewall unit is prevented.

A disadvantage associated with the previously disclosed self-assembly drawer kits is that the components of the drawer or the drawer sidewall unit must be matched to the rear wall of the drawer. For example, a flexible combination of a drawer sidewall unit and various drawer rear walls is implemented in a comparatively unfavorable manner in the previously disclosed self-assembly drawer kits.

SUMMARY OF THE INVENTION

The present invention has as its object to make available an alternative device for mounting a rear wall on a movable furniture component of a piece of furniture.

The present invention is based on a device for mounting a rear wall on a movable furniture component of a piece of furniture, in particular, a drawer, wherein the movable furniture component comprises a rear wall and a drawer sidewall unit.

If the movable furniture component is configured as a drawer, the movable furniture component comprises, for example, one bottom, one rear wall and two lateral walls formed opposite one another and/or two drawer sidewall units. The lateral walls each extend advantageously parallel to a longitudinal axis of the drawer sidewall unit. The drawer sidewall unit in this case can form the lateral wall or can be a part of a lateral wall of the movable furniture component.

The drawer is displaceably connected to the piece of furniture, for example, via two drawer runners arranged opposite one another in each case. A drawer runner comprises, for example, a carcass rail secured to an inner lateral wall of the piece of furniture and a drawer rail movably supported relative thereto and arranged on an under side of the drawer, in particular, on an under side of the drawer bottom and/or the drawer sidewall unit.

The essential aspect of the present invention is that the device is envisaged for arrangement between a rear wall holder extending on a drawer sidewall unit in a plane of the rear wall and the rear wall, and that the device comprises an engagement mechanism for engagement in the rear wall holder.

The engagement mechanism connects the device to the rear wall holder, for example, by an overlapping engagement on the rear wall holder.

The device is preferably embodied in such a way that the device is capable, in particular, without the use of tools, of being mounted between the rear wall and the drawer sidewall unit. The engagement mechanism of the device is embodied in such a way, for example, that the device can be arranged on the rear wall in an initial pre-assembly step, in particular, without the use of tools. A suchlike embodiment of the device is also known as an RTA solution (RTA—Ready To Assemble).

As a result of this embodiment of the device, assembly of the rear wall of the movable furniture component can be achieved by a fitter on-site at the customer's premises in a comparatively simple manner and without the use of tools.

It is conceivable for the device to be pushed into and/or inserted on the rear wall in an initial assembly step. Pre-assembly of the device on the rear wall can take place in this way, for example, in the factory. In a further assembly step following the first assembly step, the rear wall is connected to the device on the rear wall holder, for example, by being inserted or pushed on, for example, in the course of the assembly of the movable furniture component by a fitter.

It is also advantageous that the rear wall is arranged on the rear wall holder initially, and the device is arranged on the rear wall and the rear wall holder in a following assembly step, so that the device connects the rear wall and the rear wall holder, in particular, as a clamped connection.

The rear wall of the movable furniture component is preferably executed in metal. It is also conceivable for the rear wall to consist of one or a combination of the following materials: wood, plastic, metal, glass, fabric.

Where appropriate, the device may be executed in plastic. Comparatively cost-effective manufacture is conceivable by means of a plastic injection molding process.

In an advantageous embodiment of the present invention, the device is embodied so as to be capable of being pushed underneath an element protruding from a principal plane of the rear wall along the principal plane of the rear wall and the projecting part, wherein the projecting element advantageously has a projecting part.

It is also conceivable for the device to be embodied in such a way as to be capable of being pushed in parallel to the principal plane of the rear wall, in particular, along the principal plane of the rear wall, into the protruding element, and into an opening in the protruding element.

As a result, pre-assembly of the device on the rear wall is achievable in a comparatively simple manner.

The protruding element can be configured so as to protrude vertically relative to a principal plane of the rear wall on a short, narrow, lateral edge of the rear wall. The protruding element is present advantageously on both of the mutually opposing, narrow lateral edges of the rear wall. The protruding element can be configured, for example, on all the lateral edges of the rear wall.

The protruding element with a projecting part can also be arranged so that it projects in an L-shaped manner on a lateral edge of the rear wall. The protruding element with the projecting part and with the large lateral surface of the rear wall thereby forms a U-shaped profile, for example, on the lateral regions of the rear wall. For example the device, in particular, the basic body of the device, is embodied to be pushed into the U-shaped profile of the rear wall section and to be held advantageously in a clamping manner, for example, by the U-shaped profile of the rear wall section. The device comprises, in particular, a step to receive the projecting part.

It is also advantageous for the device to have holding elements, wherein the holding elements are configured to engage in a rear wall section, in particular, protruding from a principal plane of the rear wall.

The holding elements are preferably configured on the device in such a way that the device with its rectangular basic body and the holding elements possess a thickness d, wherein the thickness d is smaller than or the same as a width b of the element protruding from a principal plane of the rear wall. For example, the basic body possesses a thickness d, such that the device together with the basic body is capable of being pushed into the protruding element, in particular, with the holding elements at the front. As a result, the holding elements are able to engage in a recess in the rear wall. The basic body, for example, the thickness d of the basic body, can have a dimension such that the device, in particular, together with the holding elements, is capable of being pushed in on the rear wall section, for example, into the recess, in such a way that the device, in particular, the holding elements, forms a clamping connection with the rear wall.

Advantageously, the connection of the holding elements to the rear wall is capable of being released in particular with the recess.

The rear wall section is realized, for example, as a folded edge or a bend from a principal plane of the rear wall, for example, as the protruding element.

The holding elements serve exclusively, for example, for the arrangement of the device on the rear wall in a pre-assembly step or as a transport securing device for the device on the rear wall. In particular, if the device has already been pre-assembled on the rear wall in the factory.

It is advantageous, furthermore, for the basic body of the device to be of rectangular configuration, and for the holding elements to be configured so as to protrude from a narrow, long lateral surface of the basic body.

For example, in the arranged state of the device on the rear wall, the holding elements are configured protruding parallel to the principal plane of the rear wall on the narrow, long lateral surface of the device. The holding elements are advantageously configured as a latching nose, wherein a latching element can be present on the latching nose angled in relation to the locking nose.

The basic body is configured, in particular, as a rectangular box having a large, open lateral surface. The basic body is advantageously hollow internally. The weight of the device is comparatively small as a result, and the device is capable of comparatively cost-effective manufacture.

It is also advantageous for the holding elements to be of elastically deflectable embodiment.

For example, the latching nose is embodied as a spring element.

In particular, at the time of assembly of the device on the rear wall, the latching nose is deflected from a rest position on the device in such a way that the spring element is able to form a latching connection with the recess in the rear wall, wherein, in the latched state on the rear wall, the latching nose is present in its rest position.

In one advantageous embodiment of the present invention, the engagement mechanism of the device is embodied as latching elements, wherein, in the arranged state of the device on the movable furniture component, the latching elements form a latching connection with the rear wall holder.

The connection of the latching elements to the rear wall holder is advantageously releasable. In particular, the latching connection of the latching elements to the rear wall holder is of comparatively stronger configuration than the latching connection of the holding elements to the rear wall.

It is also advantageous for the latching elements to be present protruding in an L-shaped manner on the basic body of the device.

As a result of the L-shaped configuration of the latching elements, in the arranged state, a holding element of the rear wall holder and the projecting part of the protruding element can be held in a clamping manner between the latching elements and the basic body. A positionally fixed connection of the rear wall to the rear wall holder is achieved as a result. As a result, the rear wall is secured in a positionally fixed manner parallel to an opening or closing movement of the movable furniture component or parallel to a longitudinal axis of the drawer sidewall unit. The holding element of the rear wall holder extends, in the arranged state of the rear wall on the movable furniture component, for example, parallel to a principal plane of the rear wall.

It has also proved to be advantageous for the latching element, wherein, in the arranged state of the device on the rear wall holder, the latching element is envisaged for engagement in an opening in the rear wall holder.

The opening in the rear wall holder is executed on the holding element, for example, in particular on an external side of the holding element. The opening is advantageously configured as a recess, so that the latching element in the arranged state engages in the recess and/or engages behind an edge of the recess. The latching element is present as a latching hook, for example.

It is advantageous, furthermore, for the device, in particular the basic body of the device, to have spring elements in order to pretension the device on the rear wall in a direction parallel to the principal plane of the rear wall.

As a result, the generation of a noise, for example, rattling, clicking, or striking of the device and/or the rear wall, is avoided in conjunction with a movement of the movable furniture component.

The spring elements are configured, in particular, so as to protrude elastically on the basic body.

The device is assembled on the rear wall, for example, via the spring elements, in such a way that the device is present in a positionally fixed manner in a clamping position on the rear wall holder. In particular, the spring elements in the assembled state press the latching element against the holding element of the rear wall holder, in particular, against the opening of the holding device, in such a way that the device is pretensioned in a direction parallel to the principal plane of the rear wall or vertically in relation to a longitudinal axis of the drawer sidewall unit, for example, by being secured in a positionally fixed manner. In the arranged state of the device and the rear wall on the movable furniture component, for example, the rear wall is secured as a result in a positionally fixed and/or immovable manner in a vertical direction in relation to a longitudinal axis of the drawer sidewall unit.

The basic body preferably includes the spring elements. The spring elements are, for example, a component part of the narrow, long lateral surface of the basic body. Advantageously, the spring elements and the latching nose are present, in particular, in a protruding manner on the same narrow, long lateral surface of the basic body of the device.

Advantageously, the rear wall is subsequently mounted and pretensioned exclusively by the spring elements and the latching element in a positionally fixed manner on the movable furniture component, in particular, on the rear wall holder.

In an advantageous modification of the present invention, the device has a fixing element, wherein the device is capable of being secured to the fixing element via a fixed connection on the rear wall holder.

The fixing element can serve as a supplementary means of securing and/or fixing of the rear wall to the movable furniture component. The fixed connection can be embodied as a screw, a threaded bolt, a bolt and/or a plastic dowel.

The fixing element is embodied as a hole or an eye, for example. As a result, for example, a positionally fixed connection of the rear wall to the rear wall holder can be achieved. As a result, in particular, the rear wall is capable of being secured in a positionally fixed manner parallel to an opening or closing movement of the movable furniture component or parallel to a longitudinal axis of the drawer sidewall unit. Advantageously, the return of the rear wall between the device and the rear wall holder is held in a clamping and positionally fixed manner by the connection of the device to the rear wall holder via a fixed connection, for example, a screw. A noise, for example, striking or rattling of the rear wall in conjunction with a movement of the movable furniture component, is avoided as a result.

BRIEF DESCRIPTION OF THE DRAWINGS

A number of illustrative embodiments are explained in more detail on the basis of the following schematic drawings, including further details and advantages.

DETAILED DESCRIPTION OF THE INVENTION

Figure 1:
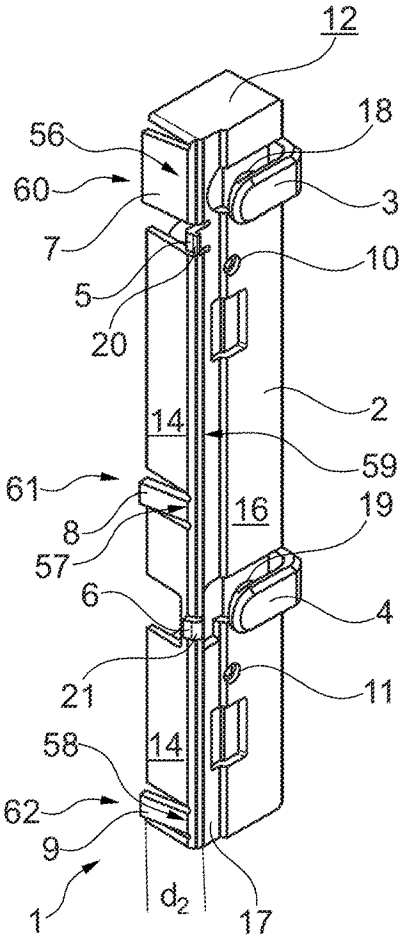
FIGS. 1-6 depict an inventive device in different views.
Figure 2:
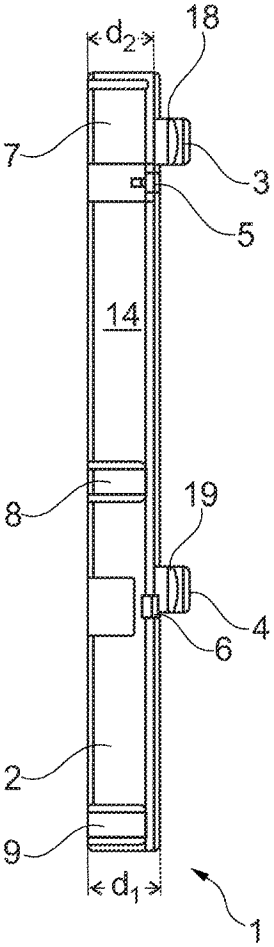
Figure 3:
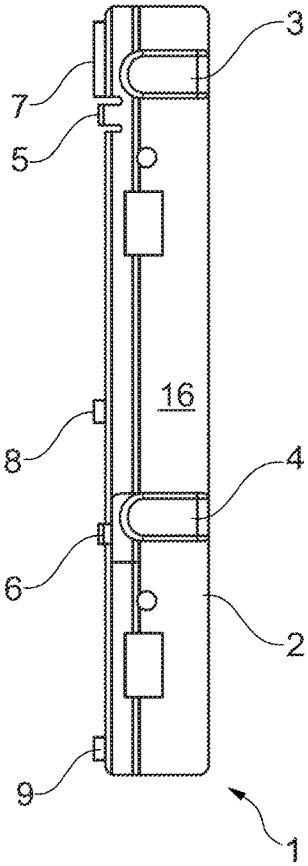
Figure 4:
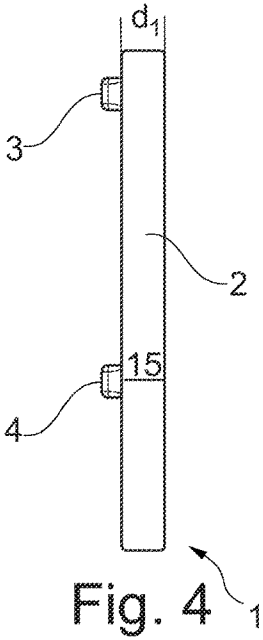
Figure 5:
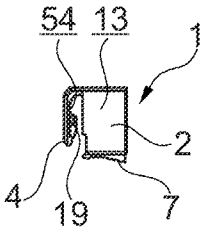
Figure 6:
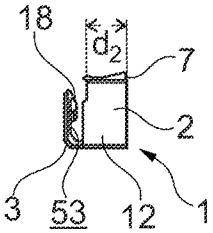

An inventive device 1 is depicted in a perspective view in FIG. 1. The device 1 comprises a basic body 2, engagement mechanism, for example, in the form of latching elements 3, 4, holding elements 5, 6, spring elements 7-9 and fixing elements in the form of drilled holes 10, 11.

The basic body 2 of the device 1 is embodied, for example, as an internally hollow, rectangular box. The basic body 2 of the device 1 comprises five lateral surfaces, being two short, narrow lateral surfaces 12, 13, two long, narrow lateral surfaces 14, 15 and one large lateral surface 16.

The large lateral surface 16 possesses a step 17, for example, which is set back inwards on the large lateral surface 16. The drilled holes 10, 11 are introduced, for example, on the large lateral surface 16. The latching elements 3, 4 are configured, in particular, on the large lateral surface 16 so as to protrude vertically from the large lateral surface 16.

The long, narrow lateral surface 15 of the basic body 2 thus possesses a width $d_1$, and the long, narrow lateral surface 14 arranged opposite the lateral surface 15 possesses a width $d_2$. The width $d_2$ is smaller than the width $d_1$ because of the step 17.

The latching elements 3, 4 are of L-shaped embodiment, for example, so that a first leg of the L is arranged on the large lateral surface 16 protruding vertically from the large lateral surface 16, and a second leg of the L runs parallel to the large lateral surface 16. The second leg of the L is advantageously configured in a region between the long, narrow lateral surfaces 14, 15 of the basic body 2. The first leg of the L is configured in addition, for example, as an extension of the long, narrow lateral surface 15. The latching elements 3, 4 advantageously comprise, on the second leg of the L, a latching hook 18, 19, wherein the latching hook 18, 19 is advantageously configured protruding on the lateral surface 53-55 on a lateral surface 53, 54 of the second leg of the L facing towards the large lateral surface 16.

The holding elements 5, 6 are arranged parallel to the lateral surface 16 and to the step 17. The holding elements 5, 6 are present on the basic body 2 and the large lateral surface 16, in particular, protruding vertically in relation to the long, narrow lateral surface 14. The holding elements 5, 6 possess a latching nose 20, 21. The latching nose 20, 21 is present, in particular, on the holding elements 5, 6 protruding vertically in relation to the step 17 and/or the lateral surface 16. It is also conceivable for the holding elements to be present protruding or set back on the long, narrow lateral surface 14.

The spring elements 7-9 are arranged in an elastic and/or protruding manner as tab-like elements on the lateral surface 14 of the basic body 2. For example, a tab-like element or a spring element 7-9 forms a part of the lateral surface 14 of the basic body 2. The spring elements are fixed to the basic body 2 in a first edge region 56-58 to a corner region 59 of the basic body 2. A second edge region 60-62, which is configured so as to be situated opposite the first edge region, is present protruding elastically from the long, narrow lateral surface 14.

FIGS. 2-6 depict the device 1 in different side views from the front, right, left, bottom or top, in each case with a view onto one of the lateral surfaces 12-16 of the basic body 2.

Figure 7:
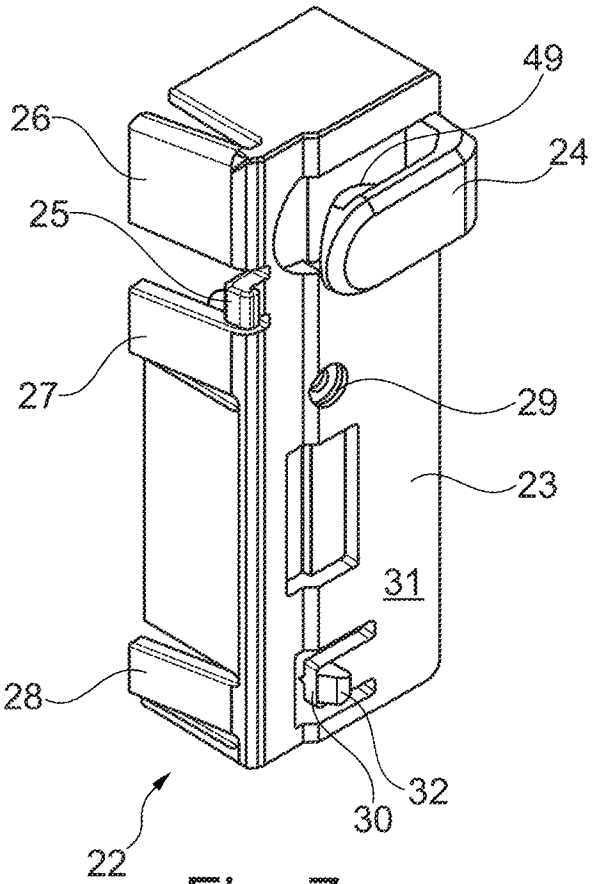
FIG. 7 depicts an oblique perspective top view from the front of a further inventive device.

FIG. 7 depicts a further variant of an inventive device 22. The device 22 comprises a basic body 23 having respectively a latching element 24, a holding element 25, spring elements 26-28, a drilled hole 29 and anti-rotation means 30.

The anti-rotation means 30 is configured as an elastic element having a nose 32 on the large lateral surface 31 of the basic body 23, in particular, protruding vertically from a large lateral surface 31 of the basic body 23.

Figure 8:
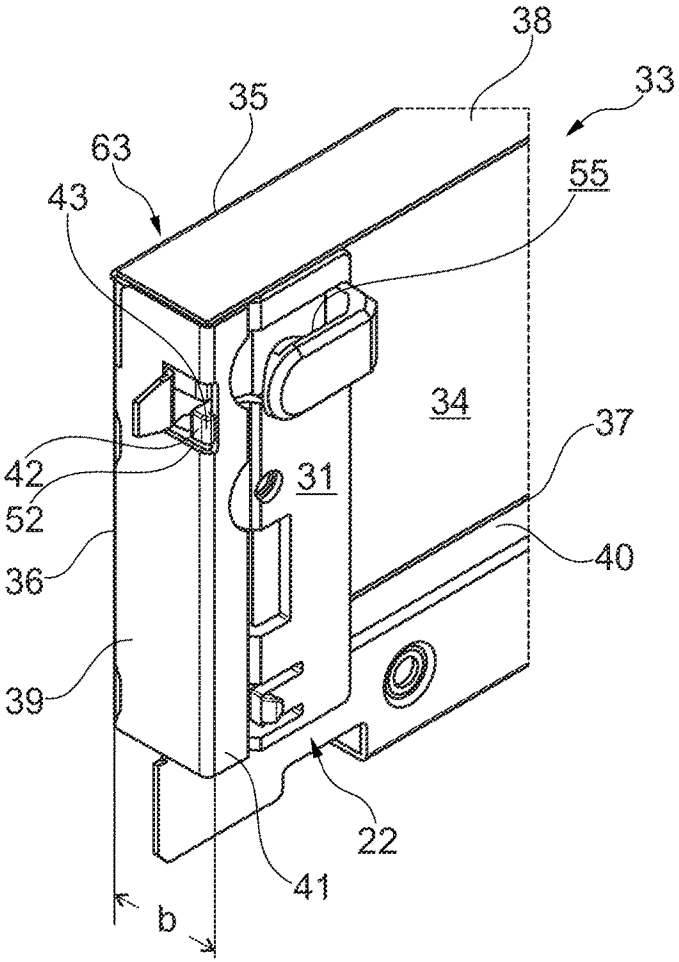
FIG. 8 depicts an oblique perspective top view from the front of the device in FIG. 7 in the arranged state on a rear side of a rear wall of a drawer.

FIG. 8 depicts a rear wall 33 of a drawer having a principal plane 34 on the rear side and elements on lateral edges 35-37 of the principal plane 34, in particular, protruding vertically from the principal plane 34, which elements are configured as folded edges 38-40. The folded edge 39 further comprises a rectangularly protruding projecting part 41. The folded edge 39 and the projecting part 41 are present, in particular, in an L-shaped configuration and constitute a U-shape together with a rear wall section 63 of the principal plane 34 from a perspective parallel to the principal plane 34 on the folded edge 39 or the projecting part 41.

The device 22 is pushed into the U-shape, for example, in a pre-assembly step with the spring elements 26-28 at the front and is held, for example, in a clamping manner between the rear wall section 63 of the principal plane 34 and the projecting part 41. For example, the holding element 25 engages additionally with its latching nose 42 into an opening 52 on the folded edge 39 and encloses the folded edge 39 and/or the projecting part 41 on the opening 52 and/or locks with the folded edge 39 and/or the projecting part 41 on the opening 52. A latching element 43 of the latching nose 42 of the holding element 25 advantageously secures the device 22 against falling out of the pre-assembly position on the rear wall 33.

A drawer bottom 46 is arranged on a drawer sidewall unit 44 of a drawer 45, in a lower region 64. A rear wall holder 47 is present in a rear region 65 of the drawer sidewall unit 44, protruding in relation to a longitudinal axis of the drawer sidewall unit 44, in particular, protruding vertically from the drawer sidewall unit 44. An opening 48, a further opening 50 and a drilled hole 51 are configured on the rear wall holder 47 on a holding element 67. The drilled hole 51 serves for fixing the device 22 assembled on the rear wall holder 47 and the rear wall 33 to the drilled hole 29 by a fixed connection, for example a screw (not represented).

A drawer runner intended to permit the longitudinal displacement of the drawer 45 is arranged in the downwardly open region 69 of the drawer sidewall unit 44. A carcass rail for the drawer runner can be installed in each case on opposite sides of the drawer 45, on a carcass wall (not represented) of a furniture carcass (not represented). The drawer 45 is thus arranged on the furniture carcass so as to be capable of longitudinal displacement.

Figure 11:
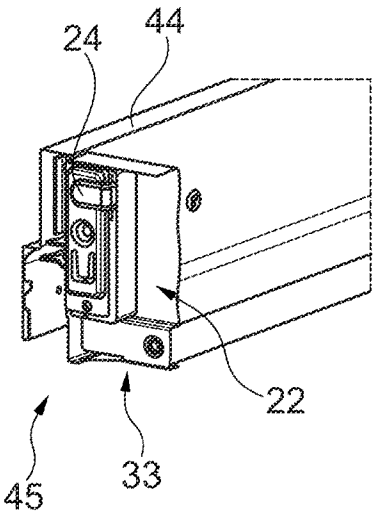
FIGS. 9-11 depict an oblique perspective top view from the rear of the device in FIG. 7 on the rear side of the rear wall of the drawer and a rear wall holder of a drawer sidewall unit in different assembly positions.
Figure 10:
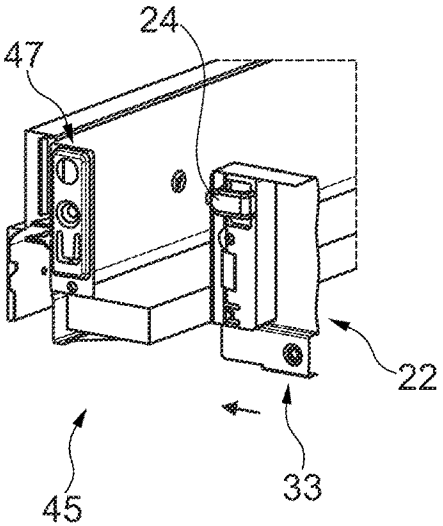
Figure 9:
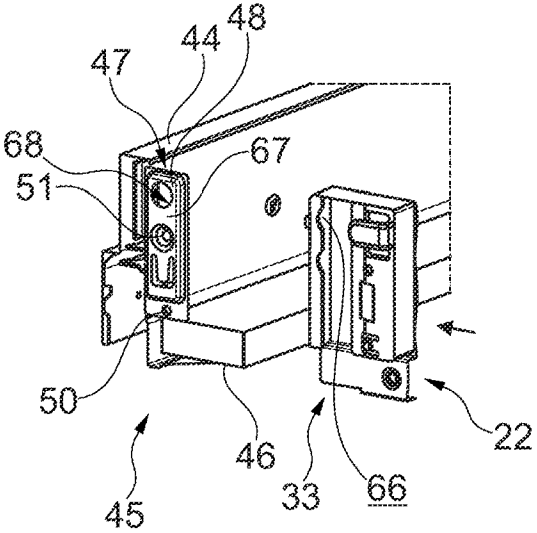

A possible sequence of assembly of the rear wall 23 together with the device 22 on the drawer sidewall unit 44 of the drawer 45 is illustrated in FIGS. 9 to 11. In an initial assembly step, the device 22 is pushed between the projecting part 41 and the principal plane 34 of the rear wall 33, until the device 22 with its spring elements 26-28 faces towards an inner side 66 of the folded edge 39 (FIGS. 9, 10). In this pre-assembly position, the device 22 is held between the projecting part 41 and the principal plane 34, for example, in a clamping manner, and is fixed to the rear wall 33 by the latched connection of the holding means 25 and the opening 52.

In a following assembly step (FIGS. 10, 11), the rear wall 33 is guided, for example, together with the device 22, in the direction of the drawer sidewall unit 44. In the process, the principal plane 34 of the rear wall 33 is advantageously oriented vertically to the longitudinal axis of the drawer sidewall unit 44. In the arranged state on the drawer sidewall unit 44, the latching element 24 of the device 22 encloses the plate-shaped holding element 67 of the rear wall holder 47, so that the latching element 24 engages with its engagement hook 49 into the opening 48 of the holding element 67. In the assembled state on the drawer sidewall unit 44, the device 22 is pressed from the folded edge 39 by the spring elements 26-28 in the opposite direction to the direction of assembly. As a result, the latching hook 49 is pressed against an abutment 68 of the opening 48. In this way, the latching hook 49 secures the device 22 and thus, for example, also the rear wall 33 against detachment from the assembled position in the opposite direction to the direction of assembly. In particular, the device 22 is arranged as a result in an immovable manner in such a way that the device 22 does not generate any noises in the event of a movement of the drawer 45.

Furthermore, the latching element 24 is configured in an elastic and sprung manner on the device 22. In this way, in the assembled state of the device 22 and the rear wall 33 on the drawer sidewall unit 44, both the projecting part 41 of the rear wall 33 and the rear wall holder 47 is clamped between the lateral surface 31 and the latching element 24 and is fixed thereby. As a result, the rear wall 33 is fixed to the rear wall holder 47, particular in an immovable manner, in a direction parallel to the longitudinal axis of the drawer sidewall unit 44.

As a protection against rotation of the device 22, in particular, in the event that the device has a sin holding element, for example, on the device 22, the device can comprise an anti-rotation means 30. The anti-rotation means 30 engages with its nose 32 into the opening 50 of the rear wall holder 47 in the assembled state of the device 22 on the drawer sidewall unit 44 and, in so doing, secures the device 22 against rotation in a plane parallel to the principal plane 34 of the rear wall 33.

Figure 12:
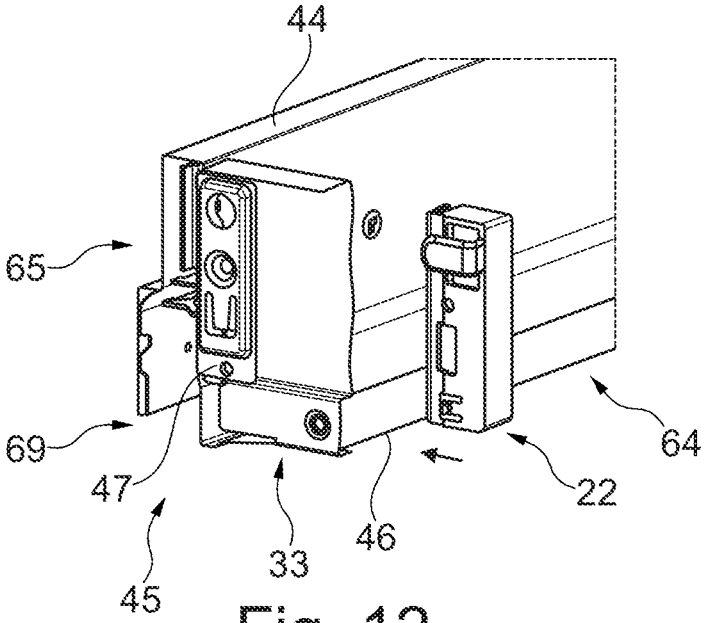
FIGS. 12-13 depict an oblique perspective top view from the rear of the device in FIG. 7 on the rear wall holder of the drawer sidewall unit and the rear side of the rear wall of the drawer in further possible assembly positions.
Figure 13:
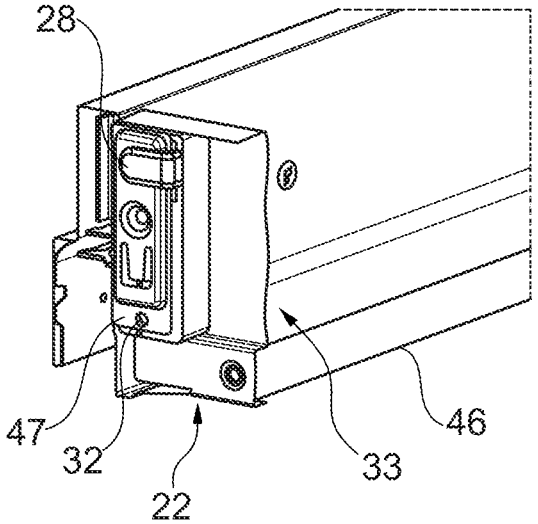

A further possible sequence of assembly of the device 22 and the rear wall 23 on the drawer sidewall unit 44 is represented in FIGS. 12 and 13. It is thus conceivable, in an initial assembly step, for the rear wall 33 to be arranged by a fitter on the drawer sidewall unit 44 and on the rear wall holder 47 (FIG. 12), and for the device 22 to be pushed into the installation position on the rear wall holder 47 and the rear wall 33 (FIG. 13).

LIST OF REFERENCE DESIGNATIONS

1 device
2 basic body
3-4 latching elements
5-6 holding elements
7-9 spring elements
10-11 drilled hole
12-16 lateral surface
17 step
18-19 latching hook
20-21 latching nose
22 device
23 basic body
24 latching element
25 holding element
26-28 spring element
29 drilled hole
30 anti-rotation means
31 lateral surface
32 nose
33 rear wall
34 principal plane
35-37 lateral edge
38-40 folded edge
41 projecting part
42 latching nose
43 latching element
44 drawer sidewall unit
45 drawer
46 drawer bottom
47 rear wall holder
48 opening
49 latching hook
50 opening
51 drilled hole
52 opening
53-55 lateral surface
56-58 edge region

59 corner region
60-62 edge section
63 rear wall section
64-65 region
66 inner side
67 holding element
68 abutment
69 region

The invention claimed is:

1. A mounting device for mounting a rear wall on a movable furniture component, the movable furniture component configured to be movably mounted on a piece of furniture, and including a rear wall, a drawer sidewall unit and a rear wall holder connected to the drawer sidewall unit and extending in a plane of the rear wall, the device being arranged between the rear wall holder and the rear wall, and comprising:

an engagement mechanism for engagement in the rear wall holder, the engagement mechanism including a substantially rectangular basic body defined by a plurality of lateral surfaces, the plurality of lateral surfaces including at least one first lateral surface having a first width, at least one second lateral surface provided opposite the at least one first lateral surface having a second width smaller than the first width, and at least one third lateral surface provided normal to the first lateral surface; and at least one generally L-shaped latching element provided on the at least one third lateral surface, the generally L-shaped latching element being configured for engagement of the mounting device with the rear wall and the rear wall holder.

2. The device according to claim 1, wherein the device is configured to be pushed underneath an element protruding from a principal plane of the rear wall and having a projecting part along the principal plane of the rear wall and the projecting part.

3. The device according to claim 1, further comprising holding elements for engaging a rear wall section protruding from a principal plane of the rear wall.

4. The device according to claim 3, wherein a basic body of the device is rectangular, and the holding elements are configured to protrude from a narrow, long lateral surface of the basic body.

5. The device according to claim 3, wherein the holding elements are elastically deflectable.

6. The device according to claim 1, wherein the engagement mechanism of the device comprises latching elements, which in the arranged state of the device on the movable furniture component, the latching elements form a latching connection with the rear wall holder.

7. The device according to claim 6, wherein the latching elements protrude in an L-shaped manner on a basic body of the device.

8. The device according to claim 6, wherein the latching elements comprise a latching hook, which in the arranged state of the device on the rear wall holder, the latching hook engages an opening in the rear wall holder.

9. The device according to claim 1, wherein the device has a basic body having spring elements, that pretension the device on the rear wall in a direction parallel to the principal plane of the rear wall.

10. The device according to claim 1, wherein the mounting device has a fixing element configured to fix the device on at least the rear wall holder.

11. The device according to claim 10, wherein the fixing element includes at least a drilled hole defined on a portion of the rear wall holder.

12. A movable furniture component having a device according to claim 1, wherein two devices are provided for fixing the rear wall to the movable furniture component.

13. A piece of furniture having a movable furniture component according to claim 12.

14. A piece of furniture having a device according to claim 1.

15. The device according to claim 1, wherein the movable furniture component is a drawer.

* * * * *